US006642658B2

(12) United States Patent
Oh

(10) Patent No.: US 6,642,658 B2
(45) Date of Patent: Nov. 4, 2003

(54) ELECTRON GUN FOR CATHODE RAY TUBE

(75) Inventor: Tae-Sik Oh, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/157,168

(22) Filed: May 29, 2002

(65) Prior Publication Data

US 2002/0180332 A1 Dec. 5, 2002

(30) Foreign Application Priority Data

Jun. 5, 2001 (KR) ..... 2001-31536

(51) Int. Cl.[7] ..... H01J 29/56; H01J 29/50
(52) U.S. Cl. ..... 315/15; 313/414
(58) Field of Search ..... 315/5.31, 5.39, 315/382, 369, 15, 16; 313/412, 428, 414

(56) References Cited

U.S. PATENT DOCUMENTS 4,271,374 A 6/1981 Kimura
6,031,326 A * 2/2000 Suzuki et al. ..... 313/414
6,407,491 B1 * 6/2002 Noguchi et al. ..... 313/414
6,476,546 B1 * 11/2002 Bae ..... 313/447
6,498,427 B1 * 12/2002 Song et al. ..... 313/414
6,507,143 B2 * 1/2003 Wakita et al. ..... 313/414

FOREIGN PATENT DOCUMENTS

JP 2000-277033 10/2000

* cited by examiner

*Primary Examiner*—Don Wong
*Assistant Examiner*—Minh D A
(74) *Attorney, Agent, or Firm*—Christie, Parker & Hale, LLP

(57) ABSTRACT

An electron gun for a cathode ray tube includes a cathode for radiating thermal electrons, control and screen electrodes disposed away from the cathode at a predetermined distance in respective order, a focus electrode disposed away from the screen electrode, the focus electrode having upper and lower cylinders and an inclined portion disposed between the upper and lower cylinders, and an anode electrode formed in a cylindrical shape, the upper cylinder, the inclined portion, and a part of the lower cylinder are disposed in the anode electrode. A length S1 of the upper cylinder in a direction of a tube axis is less than a length T1 of the inclined portion.

10 Claims, 4 Drawing Sheets

ELECTRON GUN FOR CATHODE RAY TUBE

CROSS-REFERENCE TO RELATED APPLICATIONS

This application claims priority of Korean Application No. 2001-31536 filed on Jun. 5, 2001 in the Korean Patent Office, the entire content of which is incorporated herein by reference.

FIELD OF THE INVENTION

The present invention relates to an electron gun for a cathode ray tube (CRT) and more particularly, to an electron gun that improves the electron beam focusing property while maintaining proper voltage withstanding property by improving the structure of the focus electrode.

BACKGROUND OF THE INVENTION

Generally, a color projection display system comprises red R, green G and blue B monochrome CRTs. The mono colors from the CRTs are simultaneously projected toward a screen by an optical system, thereby realizing a full-color image.

In such a display system, the luminescence of each of the monochrome CRTs should be enhanced to improve the brightness and definition of the image display on the screen. Therefore, the electron gun of the CRT emits electron beams having a relatively high current density, and each electrode of the electron gun is designed to be applied with a relatively high voltage to form electron lenses.

Accordingly, since the electron gun used for the projection display should be designed to a high current density to realize an optimal spot diameter of an electron beam, it needs a good focus property for converging the electron beams. The electrodes of the electron gun are required to have a high voltage withstanding property so that a short circuit is not occurred by an arc discharge.

To improve the focus property of the electron gun, a diameter of an electron beam-passing aperture for forming a main electron lens is enlarged.

U.S. Pat. No. 4,271,374 ('374 patent) discloses an electron gun having a first cylindrical electrode having a diameter proximal to an inner diameter of a neck portion of a CRT and a second cylindrical electrode, a part of which is disposed within the first cylindrical electrode. This structure is to minimize the spherical aberration of an electron lens while not increasing the diameter of the neck portion of the CRT.

However, in the electron gun of the '374 patent, since the second cylindrical electrode has a cup-shape, the surface area of the second cylindrical electrode, which faces the first electrode, is increased. This increases the possibility of generating an arc discharge by the high voltage (anode voltage or focus voltage), deteriorating the voltage withstanding property.

Japanese laid-open patent No. 2000-277033 discloses an electron gun for improving the voltage withstanding property. That is, a final focus electrode (to which a focus voltage is applied) disposed in a final accelerating electrode (to which an anode voltage is applied) is designed to be inclined in a longitudinal direction of the electron gun to minimize the surface area facing the final accelerating electrode. As a result, the spacing distance between the final accelerating electrode and the final focus electrode is widened.

Although the voltage withstanding property can be improved by the widened space between the electrodes, the spherical aberration is increased, deteriorating the focus property as the equipotential surface formed by the inclined final focus electrode is steeply varied along the inclined surface of the final focus electrode.

SUMMARY OF THE INVENTION

One embodiment of the present invention provides an electron gun that improves the electron beam focusing property while maintaining proper voltage withstanding property by improving the structure of the focus electrode.

One embodiment of the invention provides an electron gun for a cathode ray tube, having a cathode for radiating thermal electrons, control and screen electrodes are disposed away from the cathode at a predetermined distance in respective orders. A focus electrode is disposed away from the screen electrode, the focus electrode having an upper cylinder and a lower cylinder and an inclined portion disposed between the upper and lower cylinders. An anode electrode is formed in a cylindrical shape, the upper cylinder, the inclined portion, and a part of the lower cylinder are disposed in the anode electrode, wherein a length S1 of the upper cylinder in a direction of a tube axis is less than a length T1 of the inclined portion.

The focus electrode in one embodiment is further provided at one end of the upper cylinder with a straight portion.

An inner diameter of the lower cylinder in one embodiment is about 50–65% of an inner diameter of the upper cylinder.

The S1 and T1 in one embodiment are set to satisfy the following equation:

$$S1>2\times T1$$

An outer diameter of one end portion of the anode electrode in one embodiment is less than that of other portion.

A part of the lower cylinder in one embodiment is disposed in the one end portion of the anode electrode, and the gap between the upper cylinder and the anode electrode is greater than the gap between the lower cylinder and the one end portion.

The anode electrode in one embodiment is provided with an inclined portion corresponding to the inclined portion of the focus electrode.

BRIEF DESCRIPTION OF THE DRAWINGS

In the accompanying drawings, which are incorporated in and constitute a part of this specification, embodiments of the invention are illustrated, which, together with a general description of the invention given above and the detailed description given below, serve to exemplify the principles of the invention.

DETAILED DESCRIPTION

Figure 1:
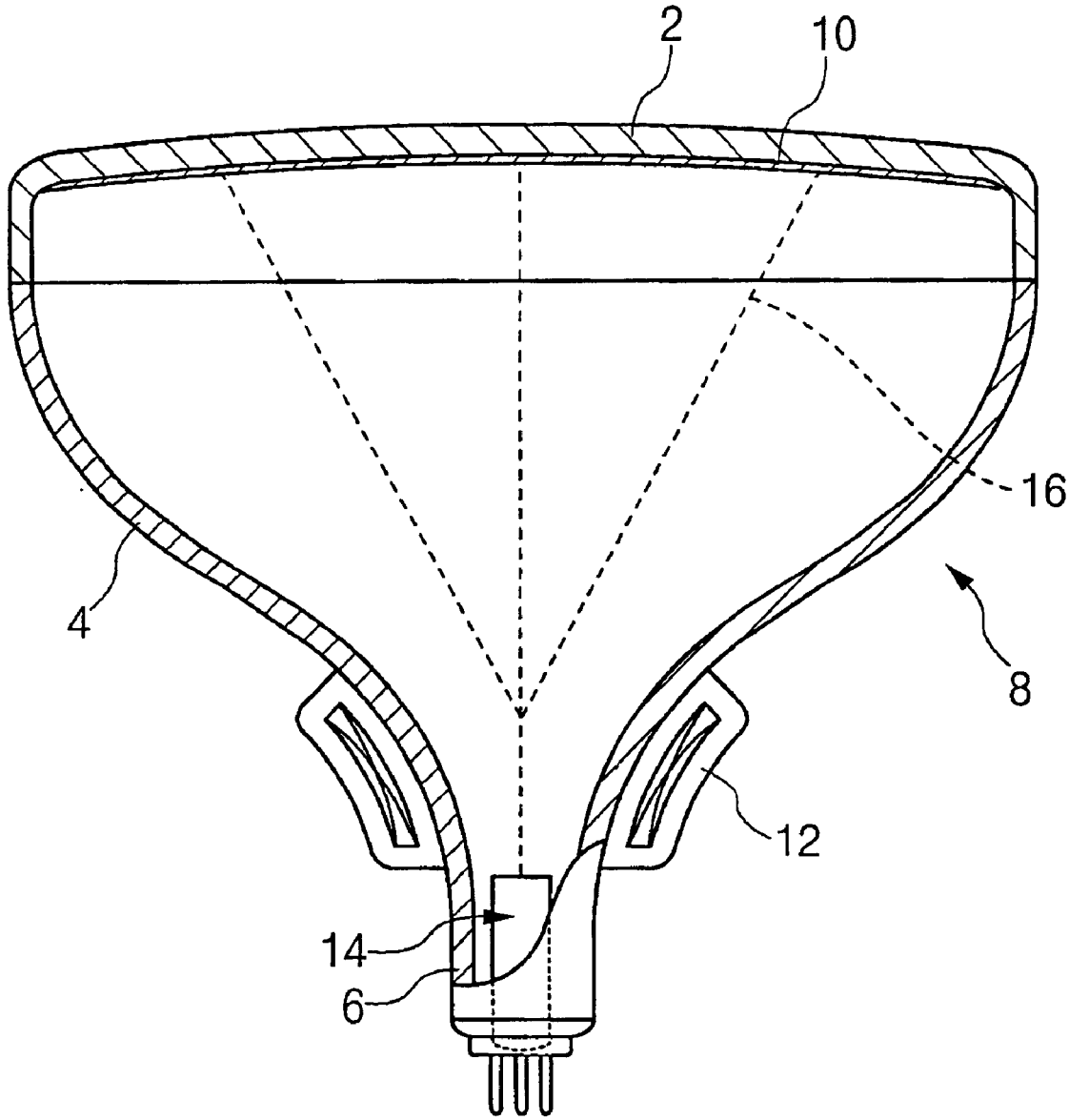
FIG. 1 is a sectional view of a CRT where an electron gun of the present invention is employed.

FIG. 1 shows a monochrome CRT used for a projection display.

The CRT comprises a tube 8 having a face panel 2, a funnel 4 and a neck 6 that are integrally sealed to define a high vacuum state.

A mono phosphor screen 10 is formed in an inner surface of the face panel 2, and a deflection yoke 12 is mounted around the funnel 4. An electron gun 14 is mounted inside the neck 6.

The electron gun 14 emits a line of electron beam whose current density is controlled by an image signal. The electron beam is deflected by the deflection magnetic field generated by the deflection yoke 12 to define the raster on the phosphor screen 10, thereby realizing a monochrome image.

Figure 2:
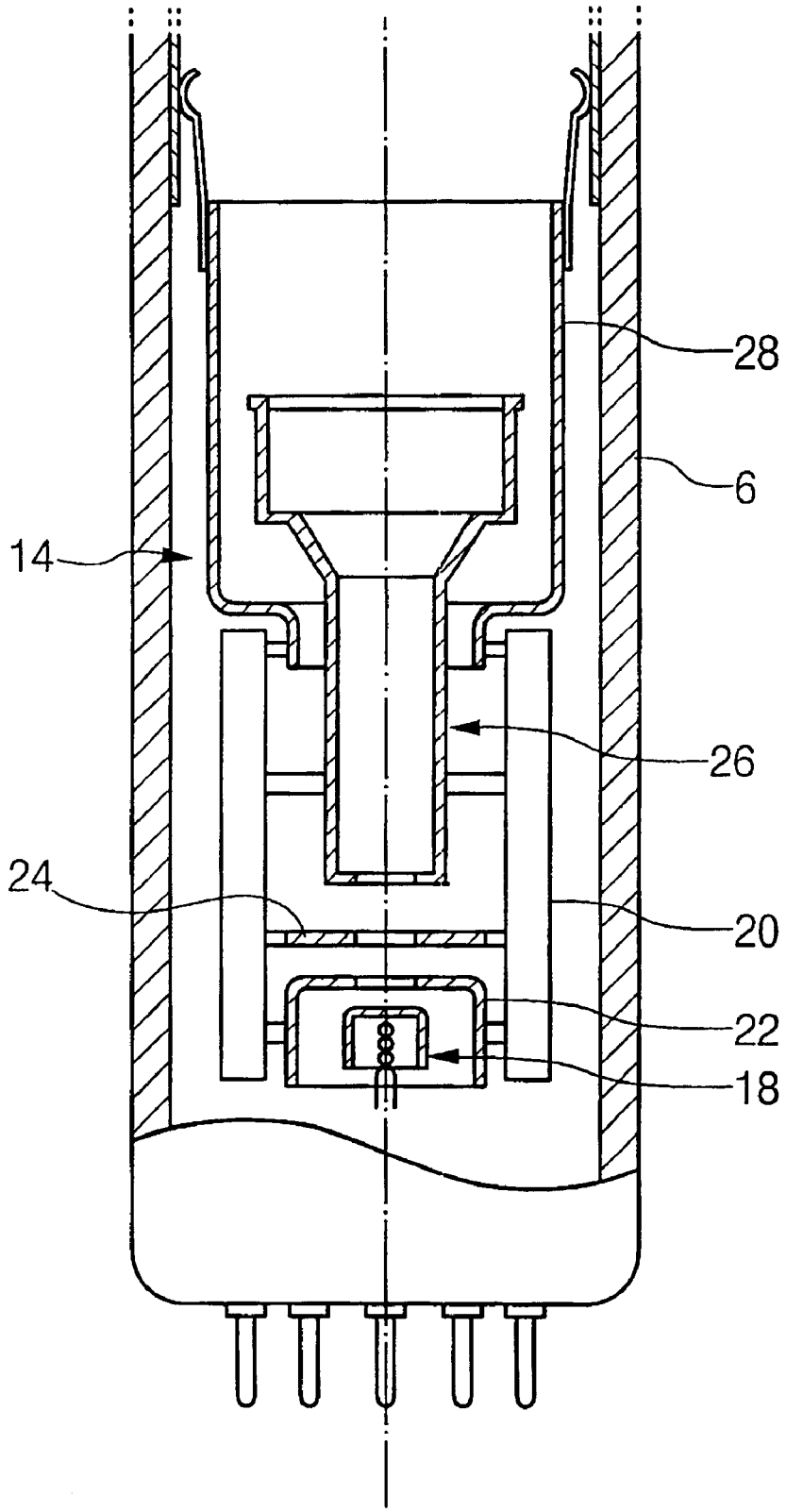
FIG. 2 is a partial sectional view of a neck portion where an electron gun according to a first embodiment of the present invention is mounted.

FIG. 2 shows an enlarged sectional view of a neck portion of the CRT where an electron gun according to a first embodiment of the present invention is mounted.

As shown, the electron gun 14 comprises a cathode 18 radiating thermal electrons, plural electrodes 22, 24, 26 and 28 spaced away from each other at a predetermined distance, and a pair of supporting members for supportably aligning the electrodes 22, 24, 26 and 28 and the cathode 18.

The number and shape of electrodes are designed according to the focusing method. In this embodiment, the electron gun 14 is designed having a bi-potential focus mechanism.

That is, the electron gun 14 comprises the control and screen electrodes 22 and 24, that are forming a prefocus lens (not shown) and defining a triode with the cathode 18, and the focus and anode electrodes 26 and 28 applied with a focus voltage and an accelerating voltage, respectively, to form a main focus lens and applied with a focus voltage and an accelerating voltage, respectively.

Figure 3:
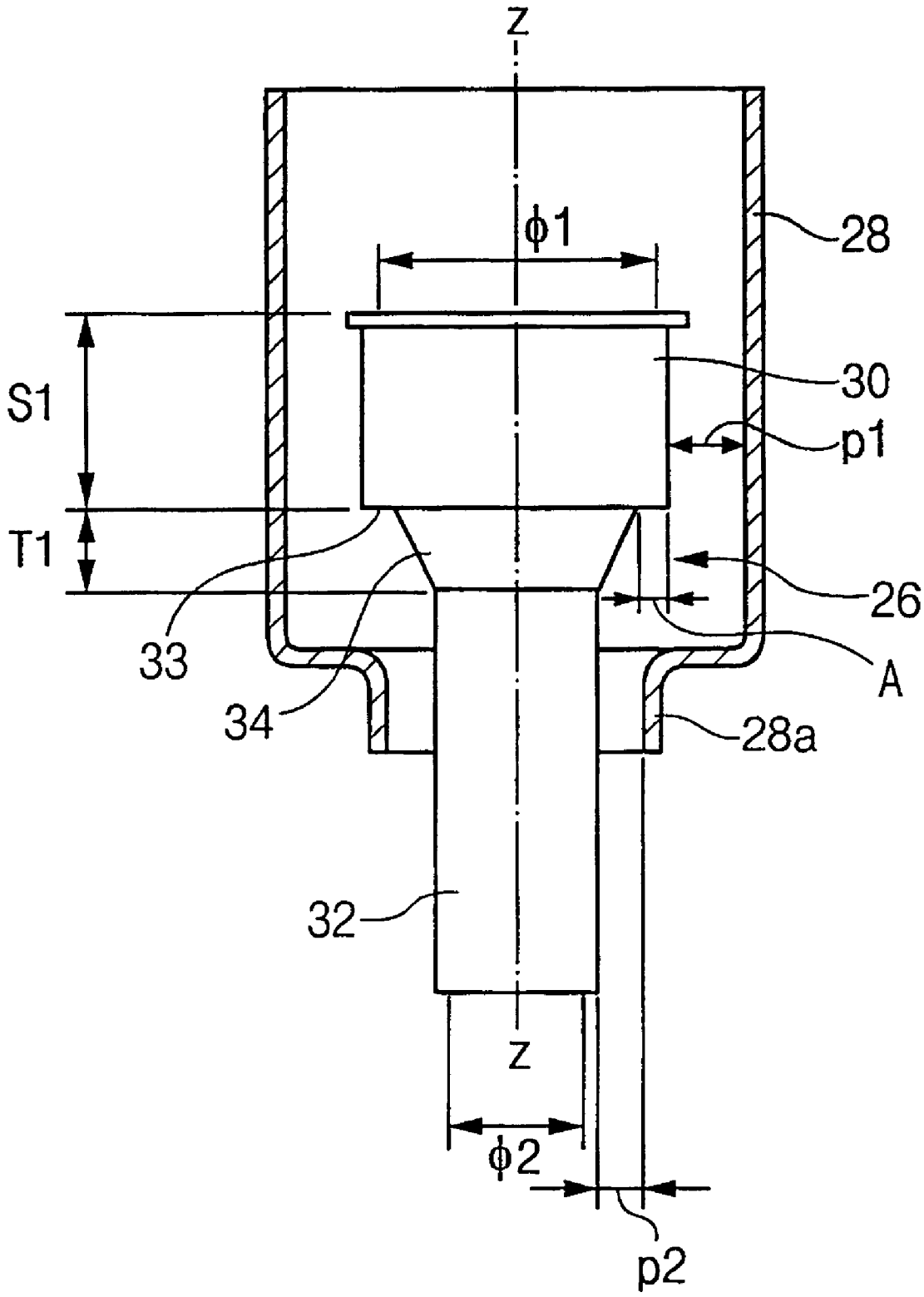
FIG. 3 is a view illustrating a focus electrode and an anode electrode of an electron gun according to a preferred embodiment of the present invention.

The focus and anode electrodes 26 and 28 are formed in a cylindrical-shape. That is, the anode electrode 28 is designed having a first end with a diameter less than that of the neck 6. A second end of the anode electrode 28 has a smaller diameter than that of the first end, as shown in FIG. 3.

In addition, the focus electrode 26 comprises an upper cylinder 30 having an inner diameter $\phi 1$, a lower cylinder 32 having an inner diameter $\phi 2$ less than the diameter $\phi 1$, and an inclined portion 34 disposed between the upper and lower cylinders 30 and 32 to connect them to each other.

The upper cylinder 30 is disposed proximal to the anode electrode 28 and the lower cylinder 32 is disposed proximal to the screen electrode 24 as shown in FIG. 2. In one embodiment, the inner diameter $\phi 2$ of the lower cylinder 32 is about 50–65% of the inner diameter $\phi 1$ of the upper cylinder 30.

Furthermore, the focus electrode 26 has a straight portion 33 between the one end of the upper cylinder 30 and the inclined portion 34. The straight portion has a predetermine length A, as shown in FIG. 3.

The upper cylinder 30, the inclined portion 34 and a portion of the lower cylinder 32 of the focus electrode 26 are disposed in the anode electrode 28, and.

The rest of the lower cylinder 32 is disposed the outside of the anode electrode 28.

In the above described electron gun, as the upper cylinder is disposed in the anode electrode 28, a main focus lens having the minimized spherical aberration can be formed between the focus electrode 26 and the anode electrode 28.

Furthermore, since the upper cylinder 30 is provided with the inclined portion 34 with enough length, the spacing distance between the focus electrode 26 and the anode electrode 28 is widened, thereby improving the voltage withstanding property.

That is, the inclined portion 34 is declined from one end of the upper cylinder 30 toward the lower cylinder 32 at a predetermined angle to connect the upper and lower cylinders 30 and 32 together with the straight portion 33.

Generally, the voltage difference between the focus electrode 26 and the anode electrode 28 of the monochrome CRT is above 20 kV. Therefore, a short circuit may occur between the electrodes. However, in the present invention, since sufficient spacing distance between the electrodes can be obtained by the inclined portion 34, an improved voltage withstanding property is achieved.

In addition, since it is preferable to form the upper cylinder 30 such that the length S1 in a direction of the tube axis is greater than the length T1 of the inclined portion 34 to optimize the main focus lens, the S1 and T1 are set to satisfy the following condition:

$$S1 > 2 \times T1 \quad (1)$$

That is, by forming the upper cylinder 30 and the inclined portion 34 to satisfy the above condition, the surface area of the upper cylinder 30, corresponding to the anode electrode 28, is increased, thereby optimizing the main focus lens to improve the electron beam focus property.

Furthermore, the spacing distance p1 between the upper cylinder 30 and the anode electrode 28 is designed to be greater than the spacing distance between the lower cylinder 32 and the end portion of the anode electrode to further improve the voltage withstanding property between the focus electrode 26 and anode electrode 28.

Figure 4:
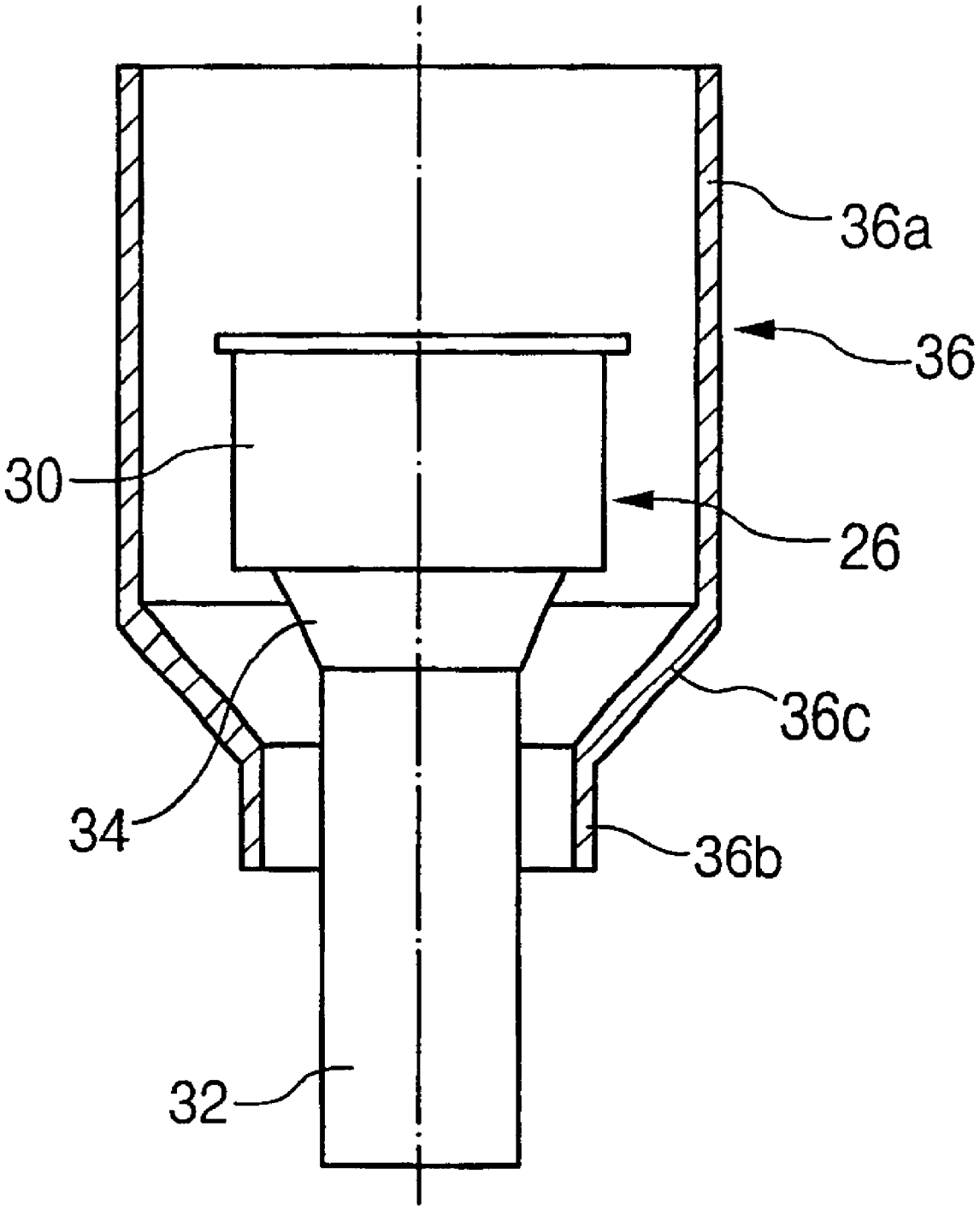
FIG. 4 is a view illustrating an electron gun according to a second embodiment of the present invention.

FIG. 4 shows a second embodiment of the present invention.

In this embodiment, the anode electrode 36 is also provided with an inclined portion 36*c* corresponding to the inclined portion 34 of the focus electrode 26.

That is, an angle portion between the main body portion 36*a* and the end portion 36*b* of the anode electrode 36 is eliminated so as to reduce the possibility of the occurrence of the arc discharge within the electron gun 14, thereby improving the voltage withstanding property.

As described above, in the present invention, by improving the voltage withstanding property, the short circuit between the electrodes can be prevented, thereby providing the stable electron beam driving as well as optimizing the main focus lens.

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. An electron gun for a cathode ray tube comprising:

a cathode for radiating thermal electrons;

control and screen electrodes disposed away from the cathode at predetermined distances, wherein the control electrode is positioned between the cathode and the screen electrode;

a focus electrode disposed away from the screen electrode, the focus electrode having an upper cylinder with a length S in a direction of the tube axis, a lower cylinder, and an inclined portion disposed between the upper and lower cylinders and having a length T in the direction of the tube axis, wherein the focus electrode includes a straight portion formed between the upper cylinder and the inclined portion; and an anode electrode formed in a cylindrical shape, wherein the upper cylinder, the inclined portion, and a part of the lower cylinder of the focus electrode are disposed in the anode electrode, and wherein the length S of the upper cylinder in a direction of the tube axis is greater than the length T of the inclined portion in the direction of the tube axis.

2. The electron gun of claim 1 wherein an inner diameter of the lower cylinder is approximately 50–65% of an inner diameter of the upper cylinder.

3. The electron gun of claim 1 wherein the length S and the length T are set to satisfy the following condition:

$$S>2\times T.$$

4. The electron gun of claim 1 wherein an outer diameter of one end portion of the anode electrode is less than an outer diameter of the other end portion of the anode electrode.

5. The electron gun of claim 4 wherein a part of the lower cylinder is disposed in the one end portion of the anode electrode, and a gap between the upper cylinder and the anode electrode is greater than a gap between the lower cylinder and the one end portion.

6. The electron gun of claim 1 wherein the anode electrode is provided with an inclined portion corresponding to the inclined portion of the focus electrode.

7. A cathode ray tube comprising:

a tube having a face panel, a funnel, and a neck that are integrally sealed;

a screen formed in an inner surface of the face panel; and an electron gun mounted inside the neck, the gun comprising:

a cathode for radiating electrons;

a screen electrode positioned away from the cathode at a first predetermined distance;

a control electrode positioned between the cathode and the screen electrode at a second predetermined distance;

a focus electrode disposed having an upper cylinder with a length S in a direction of the tube axis, a lower cylinder, and an inclined portion disposed between the upper and lower cylinders and having a length T in the direction of the tube axis, wherein the focus electrode includes a straight portion formed between the upper cylinder and the inclined portion; and an anode electrode formed in a cylindrical shape, wherein the upper cylinder, the inclined portion, and a part of the lower cylinder of the focus electrode are disposed in the anode electrode, and wherein the length S of the upper cylinder in a direction of the tube axis is greater than the length T of the inclined portion in the direction of the tube axis.

8. The cathode ray tube of claim 7 wherein an inner diameter of the lower cylinder is approximately 50–65% of an inner diameter of the upper cylinder.

9. The cathode ray tube of claim 7 wherein the length S and the length T are set to satisfy the following condition:

$$S>2\times T.$$

10. The cathode ray tube of claim 7 wherein an outer diameter of one end portion of the anode electrode is less than an outer diameter of the other end portion of the anode electrode.

* * * * *